United States Patent [19]

Shimura et al.

[11] Patent Number: 4,462,676

[45] Date of Patent: Jul. 31, 1984

[54] SKEW CONTROL APPARATUS FOR ENDLESS-BELT-SHAPED RECORDING MATERIAL

[75] Inventors: Akira Shimura, Kanagawa; Yokota Takashi, Tokyo, both of Japan

[73] Assignee: Ricoh Company, Ltd., Japan

[21] Appl. No.: 363,092

[22] Filed: Mar. 29, 1982

[30] Foreign Application Priority Data

Mar. 31, 1981 [JP] Japan ..... 56-46549

[51] Int. Cl.[3] ..... G03G 21/00

[52] U.S. Cl. ..... 355/3 BE; 198/806

[58] Field of Search ..... 355/3 R, 3 BE, 16; 198/806, 807, 808

[56] References Cited

U.S. PATENT DOCUMENTS

| | | | |
|---|---|---|---|
| 3,181,418 | 5/1965 | Durlofsky | 355/16 |
| 3,373,288 | 3/1968 | Otepka et al. | 198/807 X |
| 4,061,222 | 12/1977 | Rushing | 198/807 |
| 4,173,904 | 11/1979 | Repetto | 198/807 X |
| 4,174,171 | 11/1979 | Hamaker et al. | 355/3 BE |
| 4,197,002 | 4/1980 | Hamaker et al. | 355/3 BE |
| 4,369,878 | 1/1983 | Millevoi | 198/807 |

*Primary Examiner*—Fred L. Braun

*Attorney, Agent, or Firm*—Guy W. Shoup

[57] ABSTRACT

A skew control apparatus for use in a recording apparatus, capable of detecting the skew of an endless-belt-shaped recording material, and reversing the direction of the skew during a non-recording period, even if such skew is detected during the recording operation period.

7 Claims, 7 Drawing Figures

SKEW CONTROL APPARATUS FOR ENDLESS-BELT-SHAPED RECORDING MATERIAL

BACKGROUND OF THE INVENTION

The present invention generally relates to a recording apparatus for recording on an endless-belt-shaped recording material which is supported and driven by a plurality of rollers, in particular to a skew control apparatus for an endless-belt-shaped recording material for use in the recording apparatus.

In a recording apparatus of the above-mentioned type, an electrostatic recording type apparatus, a magnetic recording type apparatus and an electrophotographic recording type apparatus are known. In these apparatuses, it is important that such endless-belt-shaped recording material is always transported in the same posture.

The outline of a conventional recording apparatus of an electrophotographic type will now be explained by referring to FIG. 1.

FIG. 1 shows the main portion of the electrophotographic recording apparatus, in which, as the recording material, an endless-belt-shaped photoconductor 1 (hereinafter referred to as the photoconductor 1) comprising a base film made of polyethylene terephthalate and an organic or inorganic photoconductor deposited on the base film is employed. The photoconductor 1 is supported and driven in rotation in the direction of arrow A by a drive roller 2 and a driven roller 3. Around the photoconductor 1, there are arranged a charger 4 for applying charges to the photoconductor 1; an exposure apparatus 5 for exposing the electrically charged photoconductor 1 to a light image L of an original, thereby forming a latent electrostatic image on the photoconductor 1; a development apparatus 6 for developing the latent electrostatic image to a visible image by a developer; an image transfer charger 7 for transferring the visible image from the photoconductor 1 to a recording sheet; a cleaner 8 for cleaning the surface of the photoconductor 1 after the image development process; a quenching charger 9 for eliminating remaining charges from the surface of the photoconductor 1 in preparation for reuse of the photoconductor 1, followed by charging and exposure; and other members.

In a housing (not shown) of the recording apparatus, there is disposed a sheet stacking box (not shown), from which recording sheets are supplied and then discharged out of the recording apparatus through a path shown by the arrow P. In the course of the transportation, a visible image formed on the photoconductor 1 is transferred therefrom to a recording sheet by the image transfer charger 7.

The above-described recording apparatus employing the endless-belt-shaped photoconductor has an advantage over a recording apparatus employing a drum-shaped photoconductor in that the apparatus can be made small in size . On the other hand, the former has a shortcoming in that the belt-shaped photoconductor is apt to be skewed in the direction normal to the running direction of the belt. For instance, in the recording apparatus as shown in FIG. 1, the skewing of the photoconductor 1 occurs due to imperfections in the shapes, sizes and attachment positions of the drive roller 2 and driven roller 3 or due to the difference in tension applied to the photoconductor 1 by those rollers between the opposite ends thereof.

In case no countermeasures are taken against such skewing, the photoconductor 1 will gradually deviate from the correct position for latent image formation and visible image transfer.

In order to prevent such inconvenience, conventionally the skewing of the photoconductor 1 is prevented by disposing flanges at the opposite end portions of the shaft of the drive roller 2 or of the driven roller 3. This method is effective when the skewing of the photoconductor 1 is slight, since, in that case, the skewing is stopped by the side portions of the photoconductor 1 coming into contact with the flanges. However, when the variations in shape and size of the above-mentioned rollers are great and accordingly when the skewing force applied to the photoconductor 1 is great, the skewing cannot be stopped even if the side portions of the photoconductor 1 come into contact with those flanges. The result is that the side portions of the photoconductor 1 are damaged by the flanges and the image formation area in the photoconductor 1 undulates. As a matter of course, when this occurs, copy images faithful to the original images cannot be obtained.

The inventors of the present invention previously proposed a skew control apparatus capable of eliminating the above-described conventional shortcomings, which comprises an inclination mechanism for reversing the skewing direction of the endless-belt-shaped recording material by inclining one of the two rollers (corresponding to the rollers 2 and 3 in FIG. 1), over which the endless-belt-shaped recording material is trained, relative to the other roller, within a plane normal to the running direction of the recording material or within a horizontal plane; a skew detection means for generating a skewing detection signal upon detecting a predetermined amount of skewing of the recording material; and a drive switching means for receiving the detection signal generated from the skew detection means and switching the position of the inclination mechanism to its operational position as long as the detection signal is generated.

By this skew control apparatus, the shortcomings of the conventional skew control apparatus, such as the damage to the side portions of the belt-shaped recording material and the undulation of the recording material caused by its skewing, can be eliminated, since the skew detection means and the inclination mechanism are constructed in such a manner as not to apply pressure to the side edge portions of the belt-shaped recording material.

In the above-described skew control apparatus, upon detecting the skew, the skew-reversing control is done by switching the position of one or the other of the rollers to a first inclined position or a parallel position to a second oppositely inclined position. The skew-reversing control is instantly performed by a magnetic solenoid or the like, and the skewing is gradually corrected as the belt runs. As a matter of course, such skew-reversing control, that is, switching the inclined position of each roller, may be done during the recording operation of the recording apparatus. When it is done during the recording operation, the image quality may vary before and after such switching of the position of the rollers. Referring to FIG. 1, for instance, when the roller 3 is inclined during the operation of the image transfer charger 7, the gap between the photoconductor 1 and the image transfer charger 7 is abruptly changed, so that the image transfer efficiency changes before and after the inclination of the roller 3. The result is that the transferred image may be blurred. Likewise, since it is considered that the peripheral speed of the photoconductor 1 may be temporarily changed when the roller 3 is inclined, it is preferable that the roller 3 not be inclined during the exposure operation by the exposure apparatus 5. In particular, when the exposure is done by laser beams, images may be blurred considerably. This is because, in the case of the exposure by laser beams, the recording material is moved in the sub-scanning direction by an extremely small distance, for instance, a certain fraction of 1 mm, after each line of the main scanning. Therefore, so long as the load applied to the drive system of the belt is changed, regardless of the switching direction of the skewing, the peripheral speed of the photoconductor is temporarily changed. The result is that the images are considerably blurred at the time of exposure.

SUMMARY OF THE INVENTION

It is therefore an object of the present invention to provide a skew control apparatus for endless-belt-shaped recording materials, from which the shortcomings of conventional recording apparatus have been eliminated.

According to the present invention, there is provided a skew control apparatus for use in a recording apparatus which performs recording on an endless-belt-shaped recording material which is supported and driven in rotation by a plurality of rollers, the skew control apparatus comprising a skew detection means which detects the skewing of the endless-belt-shaped recording material and generates a skew detection signal when the recording material is skewed beyond a predetermined tolerance in the direction normal to the driven direction of the recording material; a skewing direction reversing control means which reverses the skewing direction of the endless-belt-shaped recording material; a timing signal generation circuit which generates a timing signal indicating that the recording apparatus is not in the recording operation period; a control circuit which generates an output when (i) the skew detection signal generated from the skew detection means and (ii) the timing signal generated from the timing signal generation circuit are input thereto at the same time; and a drive switching means which switches the operation of the skewing direction reversing control means, depending upon the presence of the output from the control circuit. In the above, the "recording operation period" signifies an entire period including various steps required for image formation, such as charging, exposure, image transfer, image fixing and others, or a period including predetermined steps which have significant effects on the image formation.

DESCRIPTION OF THE PREFERRED EMBODIMENTS

Referring to the accompanying drawings, an embodiment of a skew control apparatus according to the present invention will now be explained.

Figure 1:
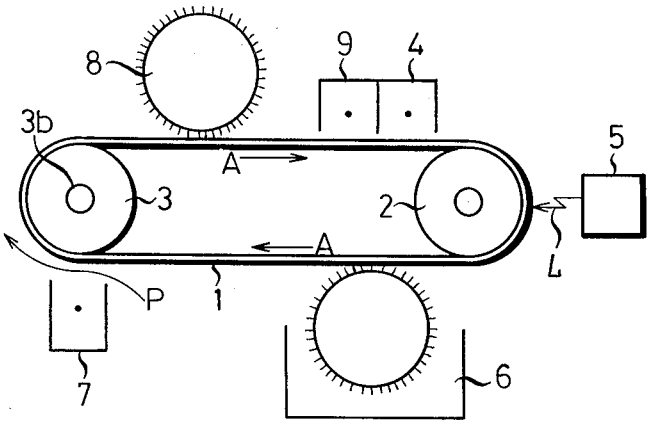
FIG. 1 PRIOR ART
FIG. 1 is a schematic side view of a conventional electrophotographic recording apparatus.

For the convenience of explanation, it is supposed that the skew control apparatus according to the present invention is employed in an electrophotographic recording apparatus of the same type as that shown in FIG. 1, which includes a endless-belt-shaped recording material.

Figure 2:
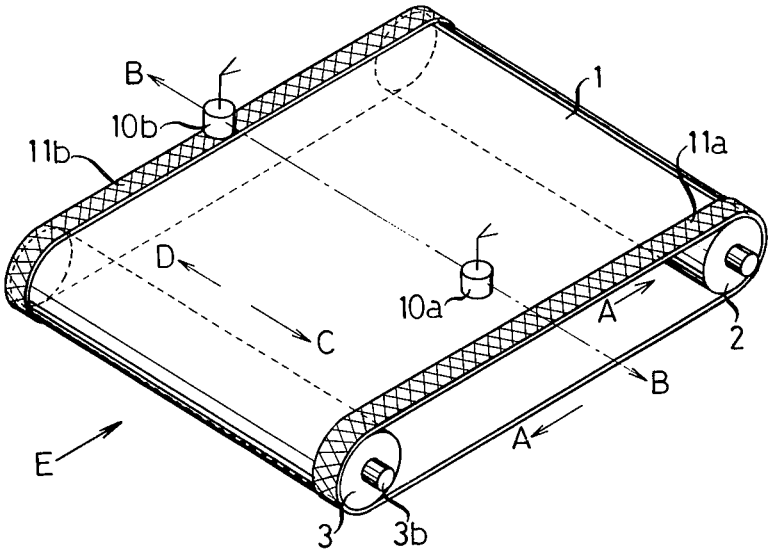
FIG. 2 is a schematic perspective view of an embodiment of a skew control apparatus according to the present invention, including an endless-belt-shaped photoconductor and a skew detection means.

Referring to FIG. 2, there are shown an endless-belt-shaped photoconductor and a skew detection means in the embodiment of a skew control apparatus according to the present invention. In the figure, apparatuses arranged around the photoconductor 1, such as an exposure apparatus, are omitted for simplification of explanation. The skew detection means in this embodiment comprises light-reflection type photosensors 10*a* and 10*b* situated above the endless-belt-shaped photoconductor 1, and detection patterns 11*a* and 11*b* disposed at the opposite end portions of the endless-belt-shaped photoconductor. The other members in FIG. 2 which bear the same reference numerals are the same as those employed in FIG. 1.

The photoconductor 1 is supported by the drive roller 2 and the driven roller 3 and is driven in the direction of the arrow A by the drive roller 2. The detection patterns 11*a* and 11*b* are attached to the entire opposite peripheral side portions of the photoconductor 1 and are moved in the direction of the arrow A, together with the photoconductor 1. The detection patterns 11*a* and 11*b* have a different reflectance from that of the photoconductor 1. The light-reflection-type photosensors 10*a* and 10*b* are situated above the detection patterns 11*a* and 11*b*. The positions of the photosensors 10*a* and 10*b* in terms of their roller-shaft direction (i.e., the direction of the arrow B in FIG. 2) are inside the detection patterns 11*a* and 11*b* and are not shifted in the directions (i.e., the direction of the arrow C or the direction of the arrow D) normal to the driving direction A of the photoconductor 1 (in the normal moving state of the photoconductor 1), relative to the opposite side portions of the photoconductor 1.

Figure 3:
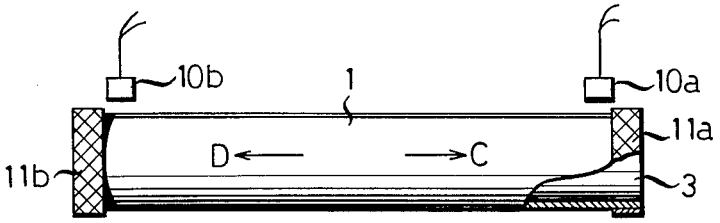
FIG. 3 is a front view of the endless-belt-shaped photoconductor and the skew detection means shown in FIG. 2, viewed from the direction of the arrow E in FIG. 2.

Referring to FIG. 3, there is shown the above-described positional relationship between the photosensors 10*a* and 10*b* and the detection patterns 11*a* and 11*b*. The view in FIG. 3 is a front view from the direction of the arrow E in FIG. 2. In FIG. 2 and FIG. 3, the same members bear the same reference numbers.

When the photoconductor 1 is being moved in the normal moving state free from skewing, the photoconductor 1 is in the detectable area of the photosensors 10*a* and 10*b*. Therefore, signals corresponding to the reflectance of the photoconductor 1 are output from the photosensors 10*a* and 10*b*.

In this embodiment, the output signals from the photosensors 10*a* and 10*b*, corresponding to the reflectance of the photoconductor 1, are pre-set so as to be at a level higher than the level of signals corresponding to the reflectance of the detection patterns 11*a* and 11*b*. Hereinafter the output signal corresponding to the reflectance of the photoconductor 1 is referred to as the H signal, while the output signal corresponding to the reflectance of the detection patterns 11*a* and 11*b* is referred to as the L signal or the skew detection signal.

In the course of repeating the copying process including the charging, exposure, image transfer, image fixing and cleaning steps, when the photoconductor 1 is skewed in the direction of the arrow C due to imperfections in the sizes and shapes of the previously described rollers, the detection patterns 11*a* and 11*b* are shifted in the direction of the arrow C at the same time. During the shifting of the detection patterns 11*a* and 11*b*, the detection pattern 11*b* enters the detectable area of the photosensor 10*b*. At that moment, the output of the photosensor 10*b* is changed from the H signal to the L signal. During the shifting of the two detection patterns 11*a* and 11*b*, the photoconductor 1 remains in the detection area of the photosensor 10*a*, so that the output from the photosensor 10*a* is the H signal and does not change. In other words, the skewing of the photoconductor 1 in the direction of the arrow C can be detected by the output of the photosensor 10*b* being changed from the H signal to the L signal.

When the photoconductor 1 is skewed in the direction of the arrow D, which is opposite to the direction of the arrow C, that skew is detected by the output signal of the photosensor 10*a* being changed from the H signal to the L signal.

Figure 4:
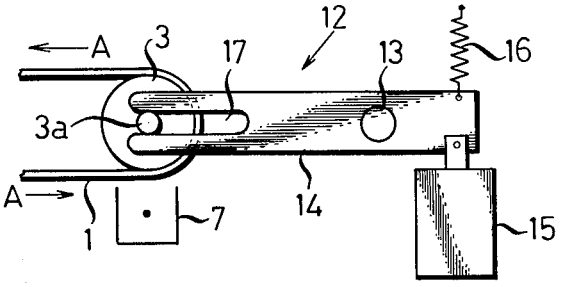
FIG. 4 is a schematic side view of a roller-inclination mechanism and a drive switching means in the skew control apparatus according to the present invention.

Referring to FIG. 4, there are shown a roller-inclination mechanism 12 and a drive switching means therefor in the embodiment of a skew control apparatus according to the present invention, in which the same members or apparatuses as those employed in the electrophotographic recording apparatus shown in FIG. 1 bear the same reference numbers.

The roller-inclination mechanism 12 includes a roller moving member 14 of which the center point is rotatably supported on a fulcrum 13 fixed to the body of the recording apparatus. In the rear end portion of the roller moving member 14, there are disposed a solenoid 15 and a return tension spring 16 which work as drive switching means. In the front end portion of the roller moving member 14, there is formed a slot which extends in the longitudinal direction of the roller moving member 14 and opens in the extreme front end thereof as shown in FIG. 4. One end portion 3*a* of a driven roller 3 is fitted in the slot 17. Because of the above-described construction, the roller end portion 3*a* is movable in the vertical direction in FIG. 4 in accordance with the rotation of the roller moving member 14. The other end portion 3*b* of the driven roller 3 (refer to FIGS. 2 and 5) is supported by the body of the recording apparatus, so as not to be vertically movable. The result is that the driven roller 3 can be inclined, with the roller end portion 3*b* being its fulcrum, by the turning of the roller moving member 14.

Above the roller moving member 14, there is disposed the tension spring 16, and below the roller moving member 14, there is disposed the solenoid 15. The solenoid 15 is electrically connected to the previously mentioned skew detection means through a control circuit which will be described in detail later, so that in accordance with the output signal generated from the skew detection means, the solenoid 15 is energized (ON) or deenergized (OFF). When the solenoid 15 is deenergized, the driven roller 3 is inclined in such a manner that its end portion 3*a* is positioned slightly below a horizontal position (indicated by the alternate long and short dash line), since the roller moving member 14 is urged to rotate counterclockwise by the tension of the spring 16.

Figure 5:
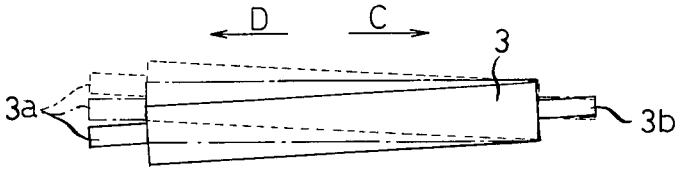
FIG. 5 is a schematic illustration of a driven roller inclined under skew control.

When the photoconductor 1 is driven in rotation in the direction of the arrow A (refer to FIG. 4), with the end portion 3*a* of the roller 3 being inclined downward as indicated by the solid line in FIG. 5, the photoconductor 1 tends to be skewed in the direction of the arrow D in FIG. 5. When the skew exceeds its tolerance in the direction of the arrow D, the photosensor 10*a* in the previously described skew detection means detects that skew. Specifically, the output signal of the light reflection type photosensor 10*a* is changed from the H signal to the L signal. When the skew in the direction of the arrow D is detected, the solenoid 15 is energized, so that the roller moving member 14 is turned clockwise (in FIG. 4) about the fulcrum 13. By that turn of the roller moving member 14, the end portion 3*a* of the roller 3 is moved upwards as shown by the broken lines in FIG. 5, whereby the skew of the photoconductor 1 in the direction of the arrow D is stopped, and the photoconductor 1 is then moved in the direction of the arrow C. When the photoconductor 1 is moved in the direction of the arrow C and its skew comes within the tolerable range, the output of the photosensor 10*a* returns to the H signal, so that the solenoid 15 is deenergized and the roller 3 returns to its initial position as shown by the solid line in FIG. 5. By the repetition of the above-described steps, the skew of the photoconductor 1 is continuously corrected.

In this embodiment, as the skew detection means, the light-reflection type photosensors and the detection patterns are disposed on the opposite end portions of the photoconductor. However, the present invention is not limited to such structure. For instance, the following skew detection means can be employed: A detection pattern is attached to an entire peripheral side portion of the photoconductor (not on the two opposite side portions of the photoconductor), and two light-reflection type photosensors are disposed side by side, with one of the photosensors being located in the detectable area of the detection pattern, and the other photosensor being located in the detectable area of the photoconductor, and the skew of the photoconductor is detected by the change in the level of the output signals from those two photosensors.

Further, it is not always necessary that such a detection pattern be disposed integrally with the photoconductor. The detection pattern can be disposed separately from the photoconductor, for instance, under the photoconductor, with a photosensor disposed so as to detect the detection pattern; the only indispensable requirement is that the reflectance of the detection area be changed when the skew of the photoconductor takes place.

The control and correction of the skew of the photoconductor are done as described above. However, as mentioned previously, if switching of the inclined position of the roller 3 is done during the recording operation, such switching may have an adverse effect on the images obtained.

Therefore, in the present invention, when the recording apparatus is in the recording operation period (defined below), the operation of the drive switching means for the roller-inclination mechanism is inhibited even if the skew detection signal is output from the skew detection means, and when the recording operation has been finished, the drive switching means is operated. In the above, the "recording operation period" signifies a period in which the recording apparatus is in such an operation state that an adverse effect would be had on the image formation if the skew of the photoconductor were to be then corrected.

For instance, in the above-described embodiment, when the roller 3 is inclined during the operation of the image transfer charger 7, the gap between the photoconductor 1 and the image transfer charger 7 is abruptly changed, so that the image transfer efficiency changes before and after the inclination of the roller 3. The result is that the transferred image may be blurred. Likewise, since it is considered that the peripheral speed of the photoconductor 1 may be temporarily changed when the roller 3 is inclined, it is preferable that the roller 3 not be inclined during the exposure operation by the exposure apparatus 5. In particular, when the exposure is done by laser beams, images may be blurred considerably. Therefore, the "recording operation period" signifies an entire period including various steps required for image formation, such as charging, exposure, image transfer and image fixing, or a period of one of the above-mentioned steps which have significant effects on the image formation. In contrast, the non-recording period signifies the periods before and after the image formation, which does not include a cleaning period. In the case where individual sheets are fed successively for continuous printing and the sheet feeding intervals are so short that, before image transfer is done on the preceding sheet, image formation is done for the following sheet, the non-recording period signifies such sheet feeding intervals.

Figure 6:
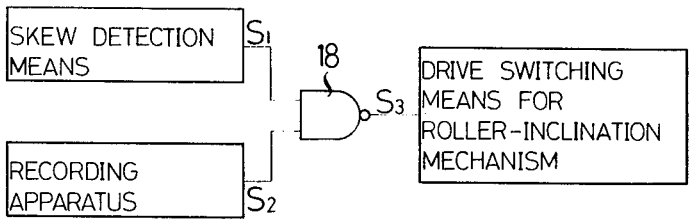
FIG. 6 is a block diagram of a control circuit of the skew control apparatus according to the present invention.

Thus, even if the skew is detected during the recording operation period, the correction of the skew is not initiated during that period, but the correction is initiated when the non-recording period begins. In the present invention, a control circuit is constructed in order to perform the above-described operation. Referring to FIG. 6, there is shown an example of such a control circuit. This control circuit includes a NAND circuit 18. To one input terminal of the NAND circuit 18, there is input an output signal, for example, an output signal $S_1$ which is output from the photosensor 10*a* in the skew detection means, while to the other input terminal of the NAND circuit 18, there is input a timing signal $S_2$, which is output from the recording apparatus, the level of which timing signal $S_2$ is changed to the L level during the non-recording operation period. An output signal $S_3$ of the NAND circuit 18 is transmitted to the solenoid 15 which serves as the drive switching means for the roller-inclination mechanism 12. As mentioned previously, the level of the output signal $S_1$ of the photosensor 10*a* is set so as to be at the level L at the time of detection of the skew of the photoconductor, and at the level H at the time of non-detecting the skew of the photoconductor. The timing signal $S_2$ is set so as to be at the level H at the time of image recording, and at the level L at the time of non-image recording.

Figure 7:
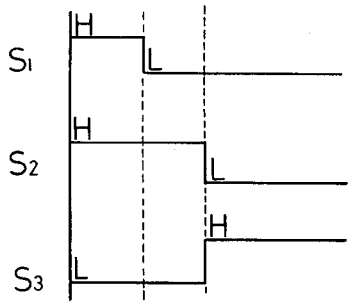
FIG. 7 is a time chart for the control circuit shown in FIG. 6.

As shown in the time chart in FIG. 7, the NAND circuit 18 outputs an H signal only when both the signals $S_1$ and $S_2$ are at the level L (hereafter, signals at the level L are referred to as the L signals). Specifically, the NAND circuit 18 outputs the H signal only when the photoconductor is skewed in the direction of the arrow D and the recording apparatus is in the non-recording period, so that the solenoid 15 is energized, and the driven roller 3 is moved from a position shown by the solid lines to a position shown by the broken lines in FIG. 5.

Thus, even if the photoconductor is skewed, the drive switching means does not work as long as the image recording continues. When the recording period is finished, for example, at the completion of the image transfer process, the drive switching means is actuated and begins to work. In this case, the skew of the photoconductor is corrected with a time lag after the detection thereof. However, since the skew of the photoconductor does not develop quickly, substantially there is no problem with such a time lag.

The embodiment described is intended to be merely exemplary and those skilled in the art will be able to make variations and modifications in it without departing from the spirit and scope of the invention.

For instance, one such variation is as follows. The skew of the photoconductor in the direction of the arrow D is detected by the photosensor 10*a*, and the roller 3 is moved from the position shown by the solid lines to the position shown by the broken lines in FIG. 5, and that position is maintained even if the output signal of the photosensor 10*a* returns to the level H. When the photosensor 10*b* located opposite the photosensor 10*a* detects the skew in the direction of the arrow C, the roller 3 is returned to the position indicated by the solid lines in FIG. 5. In this case, a second magnetic solenoid is employed instead of the tension spring 16 shown in FIG. 4, and that solenoid is controlled by an auxiliary control circuit which is similar to the circuit shown in FIG. 6. Specifically, the second magnetic solenoid is energized only when the photosensor 10*b* detects the skew in the direction of the arrow C and the recording apparatus is in the non-recording operation period. That the outputs of the two photosensors 10*a* and 10*b* come to the level L at the same time in the configuration shown in FIG. 3 does not occur. Therefore, it does not occur that the first and second solenoid work simultaneously. However, since it is not economical to supply power continuously to both magnetic solenoids when the NAND circuit outputs signals, a structure is preferred, in which the roller 3 is moved to the position indicated by the solid lines or to the position indicated by the broken lines in FIG. 5 by supplying power to one of the magnetic solenoids for a short time and stopping the roller mechanically by a pawl, that pawl being released when the other magnetic solenoid is energized.

In the above modification, the roller-inclination mechanism 12 is disposed at one end portion 3*a* of the roller 3, and the solenoid is actuated in association with one of the photosensors in the skew detection means. A further modification can be employed, in which the roller-inclination mechanisms are disposed on both opposite end portions of the roller 3 and the magnetic solenoids for those roller-inclination mechanisms are activated in association with the two photosensors of the skew detection means. Specifically, the roller 3 can be maintained at a position parallel to the roller 2 when the solenoid is deenergized. When one of the photosensors 10*a* and 10*b* disposed on the opposite sides of the photoconductor 1 in FIG. 2—for example, the photosensor 10*b*—outputs a skew detection output and detects that the skew occurs on the side of the photosensor 10*a*, the side of the roller end portion 3*a* is pushed in such a direction as to reverse the skew, for example, in the upward direction, and that position is maintained. When the skew detection signal of the photosensor 10*b* ceases by the skew being corrected in the course of repeated copying processes, the roller 3 is returned to its initial parallel position.

In the detection elements for the skew detection means, in the previously explained embodiment, light-reflection type photosensors and detection patterns are employed. Instead of such detection elements, there can be employed a skew detection means comprising a pair of contact members, which are supported so as to be rotable about the center of each contact member, one end portion of each of the contact members being in contact with one or the other side of the photoconductor, and the other end portion of each of the contact members having an interrupting member, and a pair of photo interrupters. In the case of this skew detection means, when the photoconductor is skewed, the contact member is pushed by the skewed photoconductor, so that the interrupting member which is integral with the contact member is moved to a light interrupting position, and the output signal generated from the photo interrupter is changed, whereby the skew of the photoconductor is detected. This skew detection means can be modified by replacing the photo interrupters and the interrupting members by microswitches and operation members therefor.

In the embodiment of a skew control apparatus according to the present invention, an apparatus capable of inclining rollers over which the photoconductor belt is trained so as to reverse the skewing direction has been explained. However, the present invention is not limited to such an embodiment.

For example, a method of disposing a guide roller for lifting slightly one side portion of the photoconductor belt when the photoconductor belt is skewed, and bringing about a difference in tension applied to the photoconductor belt by the two roller shafts of the photoconductor, thereby reversing the skew direction of the photoconductor belt, can be applied to the present invention.

To a skew control system in which variations in load applied to the belt drive system occur when the skew direction is controlled, thereby the peripheral speed of the photoconductor belt being temporarily changed, the present invention can also be applied with all adverse effects on the recorded images at the time of skew reversing being eliminated.

What is claimed is:

1. A skew control apparatus for use in a recording apparatus which performs recording on an endless-belt-shaped recording material which is supported and driven in rotation by a plurality rollers, comprising:

a skew detection means which detects the skewing of the endless-belt-shaped recording material and generates a skew detection signal when the recording material is skewed beyond a predetermined tolerance in the direction normal to the driven direction of the recording material;

a skewing direction reversing control means which reverses the skewing direction of the endless-belt-shaped recording material;

a timing signal generation circuit which generates a timing signal indicating when the recording apparatus is not in a recording operation period;

a control circuit which generates an output when the skew detection signal generated from the skew detection means and the timing signal generated from the timing signal generation circuit are input thereto at the same time; and a drive switching means which switches the operation of the skewing direction reversing control means, depending upon the presence of the output from the control circuit.

2. A skew control apparatus as claimed in claim 1, wherein said recording operation period is the entire period required for image formation, including the period for charging, exposure, image transfer, image fixing, or the period of an operation having significant effects on the image formation.

3. A skew control apparatus as claimed in claim 2, wherein said period of an operation having significant effects on the image formation is a period for image transfer.

4. A skew control apparatus as claimed in claim 2, wherein said period of an operation having significant effects on the image formation is a period for exposure.

5. A skew control apparatus as claimed in claim 1, wherein said skewing direction reversing control means includes a roller moving member which can be turned about a fulcrum thereof, and a front end portion of which engages an end portion of one of the rollers for supporting said endless-belt-shaped recording material; and said drive switching means comprises a magnetic solenoid, which is disposed at a rear end portion of said roller moving member and is capable of selectively holding a front end portion of said roller moving member at one of two stable positions, and a return spring or another magnetic solenoid.

6. A skew control apparatus as claimed in claim 1, wherein said skew detection means comprises detection patterns disposed on both sides of said recording material, the reflectance of said detection patterns being different from the reflectance of said recording material; and a pair of reflection-type photosensors disposed slightly inside the boundary between said detection patterns and the recording area of said recording material.

7. A skew control apparatus as claimed in claim 1, wherein said skew detection means comprises a pair of sensing members, one end portion of each sensing member being directed towards each side portion of said recording material.

* * * * *